US006085660A

United States Patent [19]

Campoli et al.

[11] Patent Number: 6,085,660

[45] Date of Patent: Jul. 11, 2000

[54] LOW SPIN SABOT

[75] Inventors: Ralph F. Campoli, Mine Hill, N.J.; John T. McGovern, Lancaster; Edwin G. Steiner, York, both of Pa.

[73] Assignee: Primex Technologies, Inc., Red Lion, Pa.

[21] Appl. No.: 09/150,850

[22] Filed: Sep. 10, 1998

[51] Int. Cl.[7] ..... F42B 14/06

[52] U.S. Cl. ..... 102/439; 102/521; 244/3.23

[58] Field of Search ..... 102/501, 520–527, 102/430, 439; 244/3.23

[56] References Cited

U.S. PATENT DOCUMENTS

| | | | |
|---|---|---|---|
| 4,109,582 | 8/1978 | Haep et al. | 102/526 |
| 4,195,573 | 4/1980 | Leeker et al. | 102/92.7 |
| 4,249,465 | 2/1981 | Ballmann | 244/3.23 |
| 4,296,893 | 10/1981 | Ballmann | 244/3.23 |
| 4,372,217 | 2/1983 | Kirkendall et al. | 102/501 |
| 4,833,995 | 5/1989 | Gotz et al. | 102/521 |
| 4,920,889 | 5/1990 | Luther | 102/521 |
| 4,936,220 | 6/1990 | Burns et al. | 102/521 |
| 4,967,668 | 11/1990 | Warren | 102/522 |
| 4,974,517 | 12/1990 | Kraft et al. | 102/521 |
| 5,063,855 | 11/1991 | Diel et al. | 102/521 |
| 5,164,540 | 11/1992 | Chiarelli et al. | 102/521 |
| 5,289,777 | 3/1994 | Sippel et al. | 102/521 |
| 5,359,938 | 11/1994 | Campoli et al. | 102/521 |
| 5,481,981 | 1/1996 | Sippel et al. | 102/522 |
| 5,635,660 | 6/1997 | McGovern | 86/21 |
| 5,640,054 | 6/1997 | McGovern | 264/3.1 |

*Primary Examiner*—Harold J. Tudor
*Attorney, Agent, or Firm*—Wiggin & Dana; William B. Slate

[57] ABSTRACT

A discardable sabot includes a first support and a second support, aft of the first support. The first and second supports are dimensioned to cooperate with an inner surface of a weapon barrel so as to maintain the saboted projectile substantially centered along the longitudinal axis of the barrel during travel of the projectile from the weapon's chamber to the muzzle. At least one of the supports is a sealing support, configured to provide a substantially gas-tight seal with the barrel and effective to allow the sabot and the projectile to be propelled forward through the barrel by expansion of propellant gas behind the sealing support. The sabot includes surfaces for permitting a flow of a portion of the gas through the sabot while redirecting such portion at least partially transverse to the axis so that the flow applies a torque to the projectile about the axis during travel of the sabot and the projectile between the chamber and muzzle.

21 Claims, 4 Drawing Sheets

LOW SPIN SABOT

BACKGROUND OF THE INVENTION

The present invention is generally related to saboted projectiles and more particularly to armor-piercing fin-stabilized discarding sabot (APFSDS) ammunition.

There exists a well-developed art in the field of APFSDS (including, inter alia, APFSDS-T (with tracer)) ammunition. APFSDS rounds have been developed for both rifled barrels (e.g., the 105 mm barrel of the relatively old M60 tank) and smoothbore barrels (e.g., the 120 mm barrel of the relatively new M1A2 tank). A rifled barrel or tube functions to spin-stabilize a projectile, a principle utilized in a majority of modern weapons from handguns to large naval guns. A projectile exiting the muzzle of a rifled tube typically has a relatively high spin rate. This rifling-induced spin rate is nominally equal to the product of the muzzle velocity (longitudinal) and the rifling pitch (measured in turns or revolutions per linear dimension). An exemplary 105 mm rifled tube has a 1–18 twist, meaning the longitudinal distance for the rifling to make one complete revolution is eighteen times the caliber of the barrel. Thus, the exemplary pitch is one turn per 1.89 meters. With an exemplary muzzle velocity of from about 1,375 to about 1,650 meters per second, the associated spin rate will be from about 730 to about 870 revolutions per second (rps). Such a spin rate would adversely affect the performance of an APFSDS round as, once the projectile is free of the sabot, it relies on its aerodynamic fins for stability at a relatively low spin rate. The rapid angular deceleration from the rifling-induced spin rate to the preferred low spin rate may: (a) damage the projectile; (b) require a weight penalty associated with providing particularly robust fins to avoid damage; and/or (c) induce wobble or other forms of instability.

Early APFSDS rounds for rifled tubes decoupled rotation of the projectile from rotation induced by the rifling. This was done by providing the sabot with an obturator which was mounted on the sabot body in such a way as to allow the obturator to rotate about the longitudinal axis of the sabot. In such a system, the obturator engages the tube bore, accommodating to the rifling and forming a seal to retain propellant gases behind the obturator. Because of its accommodation to the rifling, the obturator acquires the rifling-induced spin rate described above. This spin rate, however, is not entirely translated to the combination of the sabot body and projectile. With standard aluminum sabots and their associated projectiles, the combination typically has a sufficient moment of inertia about the longitudinal axis to overcome the static frictional force along the annular engagement between the obturator and sabot body to allow rotation of the obturator relative to the sabot body. Thus, the sabot body and projectile spin at a rate less than the obturator. A properly designed slip obturator results in a projectile spin rate of approximately ten percent of the rifling-induced spin rate or roughly 70 rps with certain projectiles.

More recently, sabot bodies substantially formed of composite materials have been introduced, offering a significant weight reduction over their aluminum predecessors. These composite sabots further reduce weight and further increase performance from smoothbore tubes. Exemplary methods and apparatus for manufacturing such sabots are disclosed in U.S. Pat. Nos. 5,635,660 and 5,640,054, the disclosures of which are incorporated herein by reference in their entireties. Such lightweight sabots have less polar moment of inertia, making it more difficult to incorporate a slip obturator which produces a sufficiently low projectile spin rate when fired from a rifled tube.

BRIEF SUMMARY OF THE INVENTION

Accordingly, in one aspect the invention is directed to a discardable sabot for adapting a subcaliber projectile to be fired from a weapon having a chamber and a barrel extending from the chamber along the longitudinal axis to a muzzle. The sabot includes a first support and a second support, aft of the first support. The first and second supports are dimensioned to cooperate with an inner surface of the barrel so as to maintain the projectile substantially centered along the axis during travel of the projectile from the chamber to the muzzle. At least one of the first and second supports is a sealing support, configured to provide a substantially gas-tight seal with the barrel and effective to allow the sabot and projectile to be propelled forward through the barrel by expansion of propellant gas behind the sealing support. The sabot includes surfaces for permitting a flow of a portion of the gas through the sabot while redirecting such portion at least partially transverse to the axis so that the flow applies a torque to the projectile about the axis during travel of the sabot and projectile between the chamber and muzzle.

Implementations of the invention may include a variety of additional features. The surfaces may be dimensioned to direct the flow effectively to produce sufficient torque on the projectile so that, upon exit from the muzzle, the projectile has an angular velocity about the longitudinal axis of between 40 rps and 100 rps in magnitude. The angular velocity may be between 60 rps and 80 rps in magnitude. The barrel may have rifling and the torque may be a first torque opposite to a second torque applied to the sabot by engagement of the sabot with the rifling during the travel of the sabot and projectile between the chamber and the muzzle. The surfaces may define passageways through the sealing support.

The first and second supports may be formed by a plurality of longitudinal segments substantially identical to each other and having an assembled configuration surrounding the projectile and secured thereto against relative longitudinal movement. The assembled segments may further define a body portion extending at least between the first and second supports. The sabot may further include an annular deformable obturator encircling the sealing support for forming a seal which accommodates the rifling. During travel of the sabot and projectile between the chamber and the muzzle, the first torque may act upon the sealing support and the second torque may act upon the obturator so as to cause rotation of the assembled segments relative to the obturator.

The barrel may have a smoothbore and the surfaces may be positioned so that the torque is positive. The sealing support may be the second support. The first support may have surfaces defining a plurality of vents for venting the portion of the gas from between the first and second supports to forward of the first support. The first support may form a scoop for engaging air through which the sabot travels upon exit from the muzzle to separate segments of the sabot so as to disengage the sabot from the projectile.

In another aspect, the invention is directed to an ammunition system for use with a weapon having a chamber and a rifled barrel extending from the chamber along a longitudinal axis to a muzzle. The system includes a subcaliber penetrator. The penetrator has a body having a nose and a tail and a plurality of stabilizing fins projecting from the body.

A discardable sabot has an engagement portion for surrounding the projectile and engaging the projectile so as to prevent relative longitudinal movement. A sealing portion of the sabot forms a substantially gas-tight seal with the barrel. The seal is effective to allow the sabot and projectile to be propelled forward through the barrel by the expansion of gas behind the sealing portion.

Other aspects of the present invention will be readily apparent upon reading the following detailed description of the invention, and from the drawing and the claims.

BRIEF DESCRIPTION OF THE SEVERAL VIEWS OF THE DRAWING

Like reference numbers and designations in the several views indicate like elements.

DETAILED DESCRIPTION OF THE INVENTION

Figure 1:
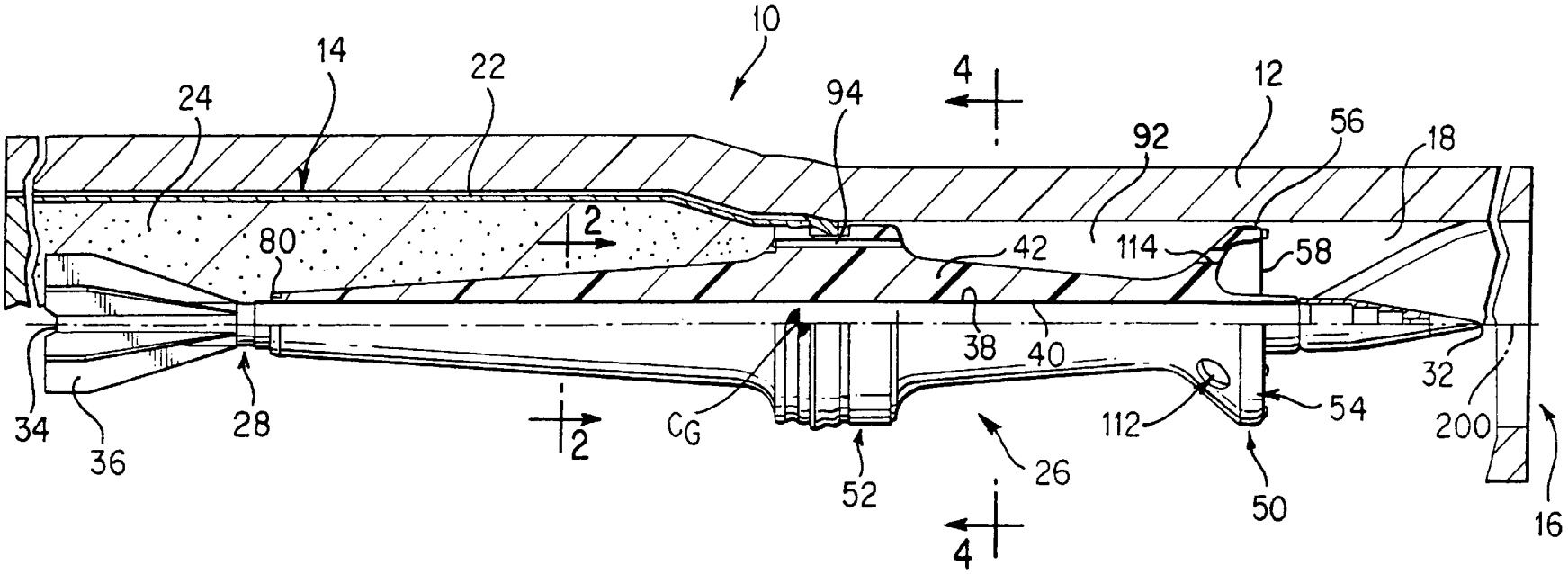
FIG. 1 is a partial cut away longitudinal cross-sectional view of a saboted projectile according to principles of the invention chambered in a weapon.
Figure 4:
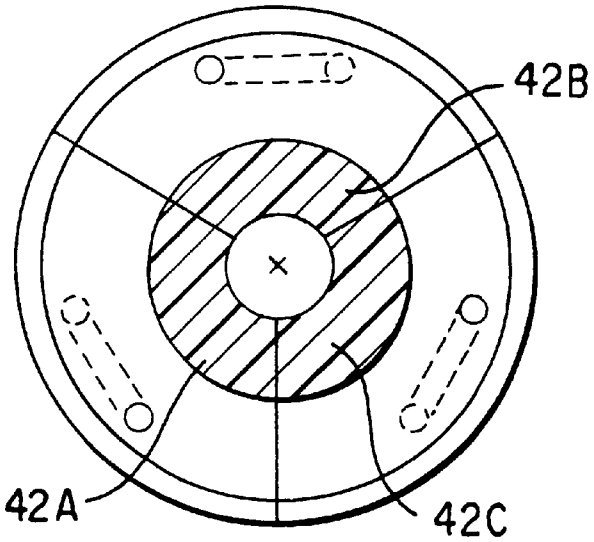
FIG. 4 is a transverse cross-sectional view of the saboted projectile of FIG. 1, taken along line 4—4.

FIG. 1 shows a weapon 10 having a tube 12 extending from a chamber 13 at the aft end of the tube to a muzzle 16 formed by a fore end of the tube. The tube extends along a central longitudinal axis 200 and has a rifled bore or inner surface 18 with a groove-to-groove diameter $D_1$ and a land-to-land diameter $D_2$, respectively 4.224 inches and 4.134 inches in the exemplary embodiment. As shown in FIG. 1, the rifling has a right hand twist as is common for weapons of U.S. manufacture although the invention is equally amenable to a left hand twist.

An ammunition round 20 is provided having a case 22 accommodated within the chamber 14. The case extends from a base to a mouth and is substantially filled with a propellant 24 such as M30 (although newer, more energetic, propellants may advantageously be substituted). A saboted projectile 26 is accommodated within the mouth of the case 22, an aft portion extending into the case 22 and a fore portion extending into the tube 12. The projectile, shown as a long rod penetrator 28, includes a body 30 formed primarily of a high-density metal such as tungsten and/or depleted uranium. The body 30 extends from a nose 32 (formed as an aerodynamic ballistic tip) to a tail 34 and bears a plurality of (for example, six) fins 36 extending generally radially outward proximate the tail 34. Centrally along the body 30, the penetrator bears interlocking features 38 engageable with mating interlocking features 40 of the sabot body 42. The features 38 and 40 may be formed as screw-like threads or as annular thread-like grooves/protrusions engaged with each other so as to be effective to prevent relative longitudinal movement of the penetrator and sabot body.

Figure 2:
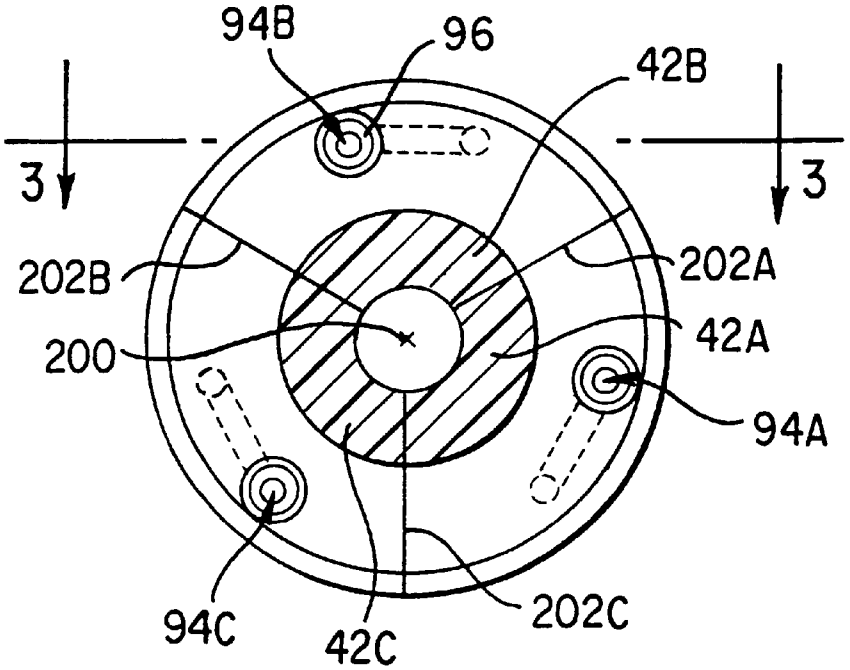
FIG. 2 is a transverse cross-sectional view of the saboted projectile of FIG. 1, taken along line 2—2.

The sabot body 42 is formed in three segments or petals 42A–42C (FIG. 2). The three petals are identical to each other which facilitates a balanced sabot and smooth discard of the sabot. The petals are separated from each other along three planar interfaces 202A–202C at 120° angles about the axis 200. The assembled sabot body fully encircles a major portion of the penetrator body. The sabot body includes fore and aft protuberances 50 and 52 dimensioned to cooperate with the bore 18 so as to maintain the projectile substantially centered along the axis 200. In the exemplary embodiment, the petals, and thus the sabot body, are primarily formed of a composite material. Suitable composite materials include: carbon and/or aramid fiber in an epoxy or other resinous matrix.

The fore protuberance 50 is formed as an annular scoop. Along the forward-facing rim of the scoop, an annular frangible band 54 is secured such as by screws. The band 54 has a cylindrical side portion or sleeve 56 in close facing relationship or light contact with the bore 18 and a front portion 58 forming a partial web extending radially inward from the sleeve 56. The sleeve 56 has an external diameter $D_3$, which, in the exemplary embodiment, is 4.13 inches. During assembly of the round, the band 54 helps secure the petals 42A–42C together in their assembled condition.

The aft protuberance 52 is longitudinally broader than the fore protuberance or scoop 50, forming a bulkhead which largely retains propellant gases behind it and provides the principal positioning of the saboted projectile along the axis 200. From the scoop 50 to the bulkhead 52, the sabot body increases in diameter which then decreases or tapers from the bulkhead to the aft end of the sabot. The bulkhead 52 has a forward cylindrical surface portion 60 having an external diameter $D_4$ which is approximately equal to the land-to-land diameter $D_2$ (e.g., about 104.85 mm in the exemplary embodiment). In the exemplary embodiment, the forward cylindrical surface 60 extends approximately 19.05 mm. The bulkhead 52 has an annular right channel having a bottom surface 62 immediately behind the front cylindrical surface 60 and radially recessed relative thereto by about 6.35 mm. The channel carries an annular L-sectioned sealing band 64 with the leg of the "L" lying flat against the surface 62 and the foot of the "L" lying flat against a shoulder surface 66 separating the surfaces 60 and 62. An annular compliant obturator 68 is carried along the leg portion of the "L" of the sealing band 62. The obturator is located between the foot of the "L" of the sealing band and an annular shoulder 70 separating the surface 62 from an aft surface 72. In the exemplary embodiment, the aft surface 72 is of similar overall diameter and length to the front surface 60 and bears an annular crimping groove 74 to which the case 22 may be crimped about its mouth. At the aft end of sabot, a frangible annular band 80 further secures the petals in their assembled condition. With the round chambered in the weapon, an annular saddle space 92 is defined between the scoop 50 and bulkhead 52. The space is so named due to the saddle-like sectional profile of the sabot body between the scoop and bulkhead.

In each petal, a passageway 94A–94C extends through the bulkhead 52. The passageways ultimately allow propellant gas communication between the region aft of the bulkhead and the saddle space. In the exemplary embodiment, the passageways 94A–94C are each formed predominantly having a circular cross-section, oriented in a plane parallel to the axis 200, but, within such plane, at an angle θ (20° in the exemplary embodiment) relative to the direction of the axis 200. For reference purposes, the positive direction along a flow path through each passageway is from aft of the bulkhead to forward of the bulkhead as the positive directions along the axis 200 and along the rifling are also from aft to forward. Thus, the angular component of the passageway direction about the axis 200 is of the same sign as the angular component of the rifling direction about the axis 200. Thus, in the case of a weapon with a left hand twist rifling, the direction of the passageways would similarly change from that shown for right hand twist rifling. For reference purposes, positive values of θ are defined as corresponding to passageway directions pointing as does right hand twist rifling.

Figure 3:
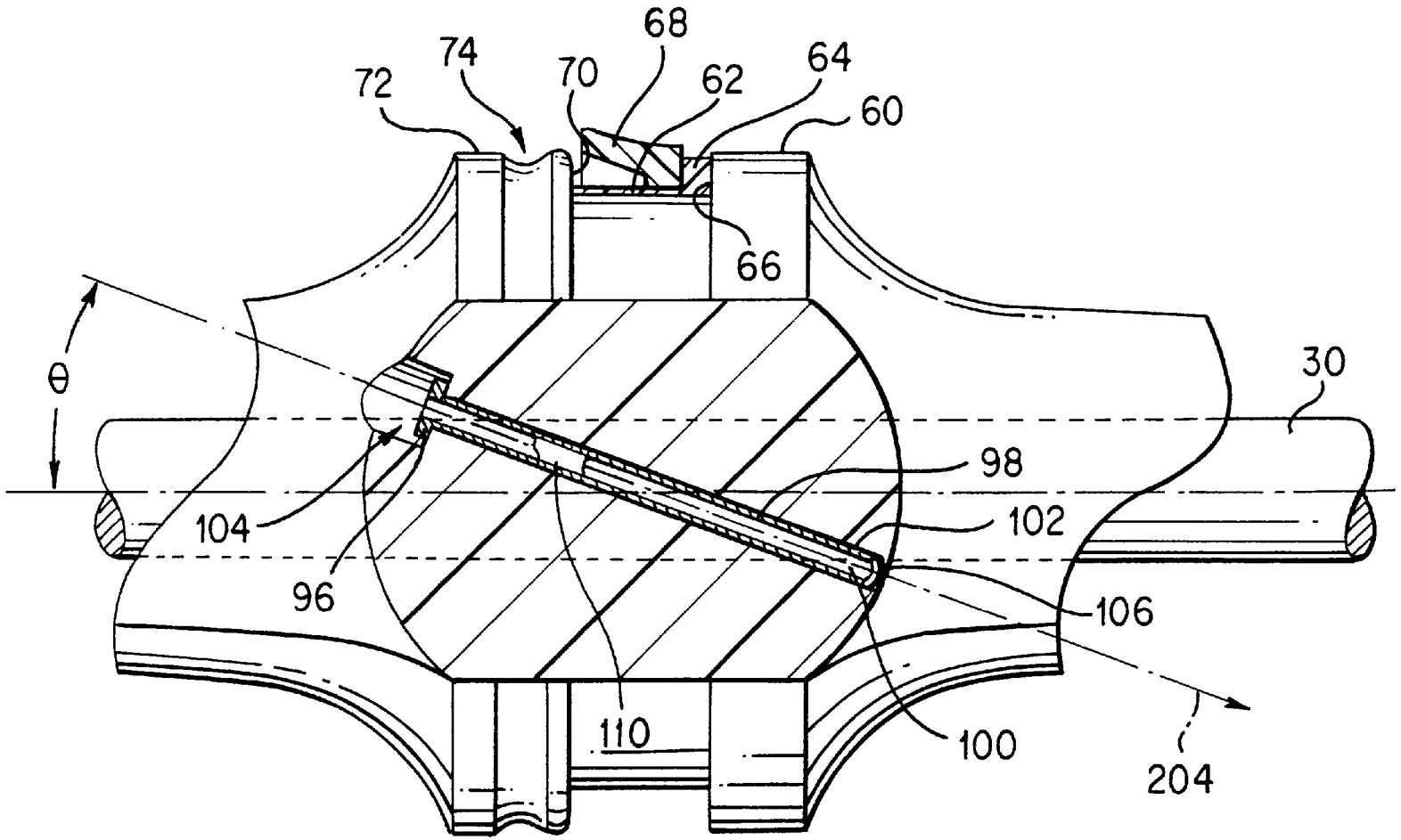
FIG. 3 is a longitudinal cross-sectional view of the saboted projectile of FIG. 2, taken along line 3—3.

As shown in FIG. 3, each passageway 94A–94C is substantially defined by a jet tube having a head or flange 96 and a body 98 extending downstream along the associated passageway/flow direction 204. The jet tube has a circular cylindrical inner surface 100 along both the body and head and an outer surface having a circular cylindrical portion 102 along the body 98. The head 96 is accommodated on an annular shoulder of a counterbore-like pocket 104 in an aft surface of the bulkhead which defines an inlet to the passageway. An upstream end 106 of the jet tube forms an outlet approximately flush with the forward surface of the bulkhead. In the exemplary embodiment, the jet tube is formed with the inner surface 100 having a diameter of about 5.4 mm and the outer surface portion 102 having a diameter of about 6.35 mm and is formed of aluminum. The jet tube material and wall thickness are chosen to provide the jet tube with sufficient heat resistance and strength to withstand the passage of hot propellant gases through the jet tubes.

The sabot is initially assembled with three plugs 110 each sealing an associated one of the jet tubes/passageways 94A–94C. The plugs may be formed of a solid elastomer (e.g., neoprene, silicone, and the like) or a semi-solid material (e.g., a silicone grease). The plugs 110 are effective to provide a watertight and airtight seal of the passageways under normal conditions so that when the round is assembled, there is no water or air communication through the passageways, thereby maintaining the integrity of the propellant in the case.

Ignition of the propellant raises the pressure within the case sufficiently to overcome any mechanical/adhesive interaction between the plug and jet tube and, thereby, drive the plugs out of the downstream ends of the jet tubes into the annular saddle space. Propellant gases continue to rush through the jet tube outlets. Because the jet tube outlet is at an angle (the angle θ for the illustrated straight tubes) to the axis 200, the flow of propellant gas through the jet tubes produces a torque on the sabot. The torque will depend on factors including the mass flow rate (M) of the gas, the velocity (V) of the gas exiting the jet tubes (or more particularly, the circumferential component about the axis 200), as well as the radius (R) of the outlet 106 of the jet tubes from the axis 200. With the velocity of the flow along the tubes designated V, the circumferential velocity of the exiting stream is $V \sin \theta + R\Omega$ where Ω is the angular velocity (spin measured in radians per second) of the sabot at the given instant. Thus, the torque (τ) applied by the interaction of the sabot with the gas is equal to $-MR(V \sin \theta + R\Omega)$. The difference between τ and the torque resulting from the frictional interaction of the obturator with the sealing band is equal to the angular acceleration of the combined sabot body and projectile multiplied by the moment of inertia of the combined sabot body and projectile. Thus, it can be seen that for given frictional interactions between the obturator and sealing band, a given moment of inertia of the combined sabot body and projectile, a suitable number, cross-sectional area, and outlet orientation of the passageways may be determined to induce a particular rate of spin of the sabot upon exit from a particular weapon. Such parameters will be advantageously determined experimentally.

As the propellant gas exiting the passageways enters the annular saddle space it is advantageously evacuated from the saddle space so as to prevent increasing pressure within the saddle space from disadvantageously decreasing the flow rate. In the illustrated embodiment, this venting is achieved by providing each petal with a vent aperture 112 in the fore protuberance or scoop 50. In the exemplary embodiment, the vents 112 are defined by cylindrical circular surfaces 114 extending longitudinally through the scoop. Each vent has a cross-sectional area significantly greater than the cross-sectional area of a passageway 94A–94C. More particularly, the total cross-sectional venting area (three times the cross-sectional area of an individual vent in the exemplary embodiment) is significantly greater than the total cross-sectional area of the jet tubes (three times the cross-sectional area of an individual tube in the exemplary embodiment) so that the venting does not substantially hinder the flow of propellant gas through the passageways. Advantageously, the passageways/jet tubes are dimensioned and oriented so that upon exit from the muzzle of the weapon, the projectile has a spin rate much smaller than the obturator spin rate induced by the rifling. Whereas the latter may be in excess of 500 rps, the former is most advantageously equal to a design spin rate for the projectile once free of the sabot (e.g., about 70 revolutions per second). With such a configuration, once free of the sabot, there is no rapid angular acceleration (more particularly, a rapid deceleration of the projectile which would tend to interfere with its accuracy). Thus, were there no relative rotation between the sabot and obturator, upon discard the projectile would have the relatively high rifling-induced rotation typically in excess of 500 revolutions per second and would quickly decelerate, perhaps partially losing stability and thereby accuracy. The design spin rate is velocity-dependent, but for a given velocity is that spin rate at which the fins produce no net torque about the longitudinal axis of the projectile. Clearly, there is flexibility in selection of the design spin rate and there is yet further flexibility to the extent that exit spin rates other than the design spin rate may still result in higher accuracy than if the projectile had exited at the rifling-induced spin rate. Once beyond the muzzle and free of the tube, the interaction of the scoop with the ambient air produces radially outward forces on the sabot petals sequentially causing rupture of: the band 54; the sealing band 64 and obturator 68; and the band 80. This allows the petals to separate from each other, disengaging the penetrator and allowing the penetrator to proceed to its target unencumbered by the aerodynamic drag of the sabot and at the design spin rate (e.g., 70 rps).

Figure 5:
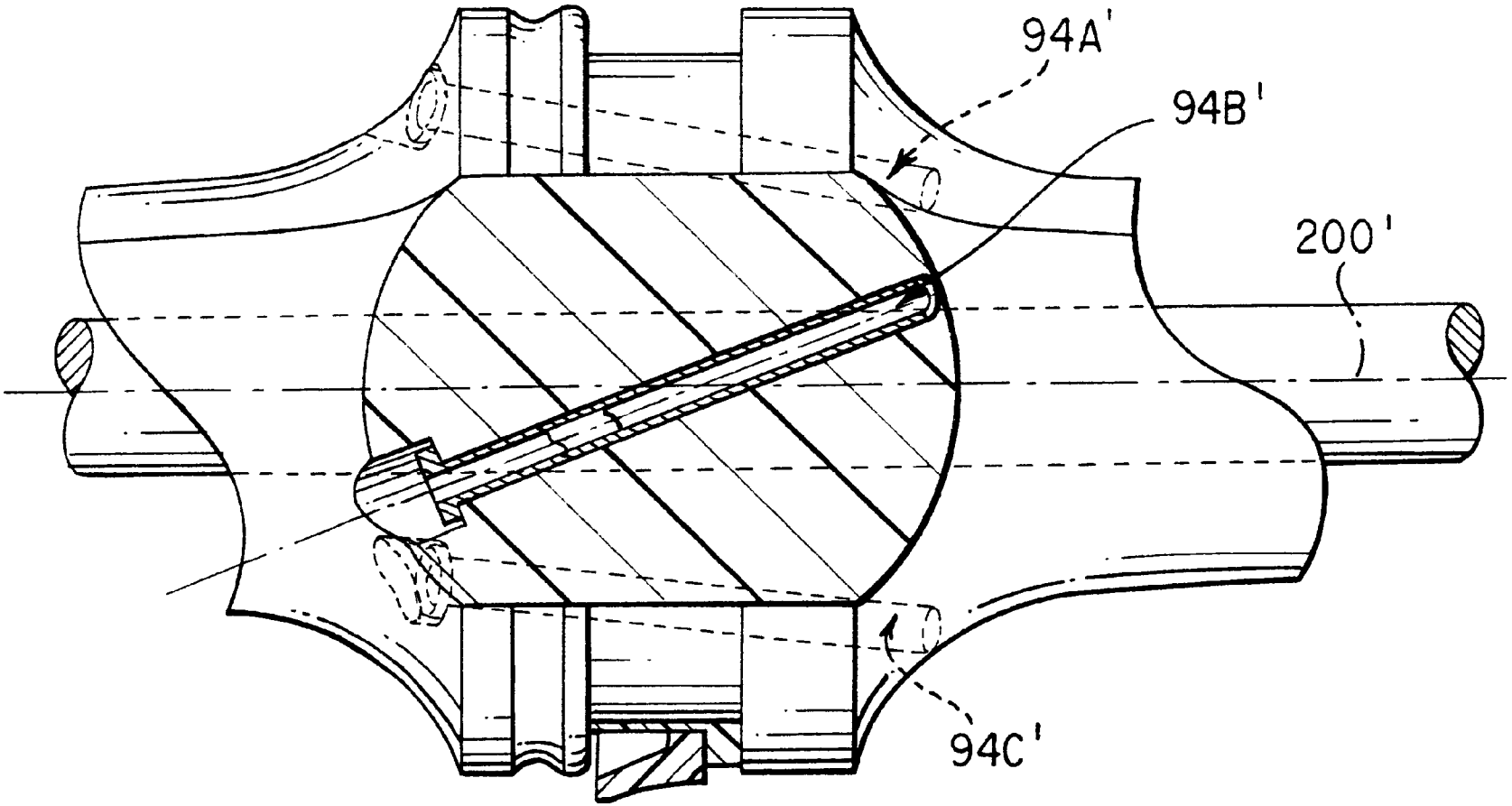
FIG. 5 is a partial longitudinal cross-sectional view of another saboted projectile according to principles of the invention.

In a second embodiment shown in FIG. 5, construction of the sabot may be nearly identical to that of the embodiment of FIGS. 1–4. A key difference is that the inclination of the passageways/jet tubes is reversed. Although such a configuration may advantageously be used with a left hand twist barrel and a projectile having a design spin rate of −70 rps at the muzzle velocity (as described above), it may also be used to pre-spin a projectile fired from a smoothbore tube. Gas flowing through these passageways 94A'–94C' produces a positive torque about the axis 200'. When fired from a smoothbore tube, the passageways are advantageously dimensioned and oriented to induce the desired spin rate (e.g., 70 rps) in a projectile which may be identical to that of the projectile of the embodiment of FIGS. 1–4.

In the exemplary embodiments, the center of gravity $C_G$ of the combined sabot and projectile falls along the axis 200 at a location thus slightly aft of the obturator 68. Since this location falls adjacent the jet tubes, it is relatively close to the center of the torque applied to the sabot by the redirection of gas flow. This proximity further contributes to projectile stability.

Although one or more embodiments of the present invention have been described, it will nevertheless be understood that various modifications may be made without departing from the spirit and scope of the invention. For example, although applied to a particular configuration of push-type sabot, the principles of the invention may be applied to other push-type sabots and to other type of sabots including pull-type sabots wherein the obturator is located in a relatively forward location (e.g., on the forward protuberance or flange). Although shown as straight jet tubes of substantially uniform cross section, the passageways may be configured in many other ways including helical tubes of uniform circular cross-section, and tubes of non-circular and/or non-uniform cross-section. Furthermore, other aerodynamic features for engaging the propellant gas may be possible.

Accordingly, other embodiments are within the scope of the following claims.

We claim:

1. A discardable sabot for firing a subcaliber projectile from a weapon having a having a chamber and a barrel, the barrel having rifling and extending from the chamber along a central longitudinal axis to a muzzle, the sabot comprising:

a first support;

a second support, aft of the first support, the first and second supports dimensioned to cooperate with an inner bore of the barrel so as to maintain the projectile substantially centered along the central longitudinal axis of the barrel during travel of the projectile from the chamber to the muzzle, at least one of the first and second supports being a sealing support configured to provide a substantially gas-tight seal with the barrel, effective to allow the sabot and projectile to be propelled forward through the barrel by the expansion of gas behind the sealing support; and a slip obturator encircling the sealing support for forming a seal which accommodates the rifling, wherein the sabot includes surfaces for permitting a flow of a portion of the gas through the sabot while redirecting such portion at least partially transverse to the central longitudinal axis so that the flow applies a first torque to the projectile about the central longitudinal axis during travel of the sabot and projectile between the chamber and the muzzle, the first torque opposite a second torque applied to the sabot by engagement of the sabot with the rifling during the travel of the sabot and projectile between the chamber and the muzzle.

2. The sabot of claim 1, wherein the surfaces are dimensioned to direct the flow effectively to produce sufficient torque on the projectile so that, upon exit from the muzzle, the projectile has an angular velocity about the longitudinal axis of between 40 rps and 100 rps in magnitude.

3. The sabot of claim 2, wherein the surfaces are dimensioned to direct the flow effectively to produce sufficient torque on the projectile so that, upon exit from the muzzle, the projectile has an angular velocity about the longitudinal axis of between 60 rps and 80 rps in magnitude.

4. The sabot of claim 1, wherein:

the surfaces define passageways through the sealing support;

the first and second supports are formed by a plurality of longitudinal segments substantially identical to each other and having an assembled configuration surrounding the projectile and secured thereto against relative longitudinal movement;

the assembled segments further define a body portion extending at least between the first and second supports; and during the travel of the sabot and projectile between the chamber and the muzzle the first torque acts on the sealing support and the second torque acts on the obturator so as to cause rotation of the assembled segments relative to the obturator.

5. The sabot of claim 1, wherein the sealing support is the second support.

6. The sabot of claim 1, wherein the sealing support is the second support and wherein the first support has surfaces defining a plurality of vents for venting the portion of the gas from between the first and second supports to forward of the first support.

7. The sabot of claim 1, wherein the sealing support is the second support and wherein the first support forms a scoop for engaging air through which the sabot travels upon exit from the muzzle to separate segments of the sabot so as to disengage the sabot from the projectile.

8. An ammunition system for use with a weapon having a chamber and a rifled barrel extending from the chamber along a longitudinal axis to a muzzle, the system comprising:

a subcaliber penetrator comprising: a body having nose and a tail; and a plurality of stabilizing fins projecting from the body;

an annular deformable obturator forming a first seal which accommodates the rifling of the barrel; and a discardable sabot comprising:

an engagement portion for surrounding the projectile and engaging the projectile to prevent relative longitudinal movement;

a sealing portion for carrying the obturator and forming a second seal with the obturator so that the first and second seals are effective to allow the sabot and projectile to be propelled forward through the barrel by the expansion of gas behind the sealing portion;

a plurality of channels extending through the sealing portion and configured to cooperate with an expanding gas behind the sealing portion and direct a portion of the expanding gas forward from the sealing portion with a nonzero velocity component about the longitudinal axis relative to the sealing portion so as to apply a torque to at least the engagement portion, such torque directed counter to a spin induced by cooperation of the obturator with the barrel and effective to cause sufficient slip between the engagement portion and the obturator so that the projectile exits the muzzle with an angular velocity about the longitudinal axis of less than 100 rps in magnitude.

9. The ammunition system of claim 8 further comprising a plurality of plugs, each such plug sealing an associated one of the plurality of channels prior to firing of the system from the weapon, and wherein each such plug is dimensioned so as to be driven out of the associated channel by expanding gas behind the sealing member upon firing of the weapon.

10. The ammunition system of claim 9 wherein each such plug is formed of a grease.

11. The ammunition system of claim 9 wherein each such plug is formed of an elastomer.

12. The ammunition system of claim 8 wherein the torque is effective to substantially counter a second torque applied via the obturator to the projectile so that after exiting the muzzle the projectile has a spin of less than 100 rps while the obturator has a spin rate of greater than 500 rps prior to disengagement of the obturator from the rifling.

13. An ammunition system for use with a weapon having a chamber and a rifled barrel extending from the chamber along a longitudinal axis to a muzzle, the system comprising:

a subcaliber penetrator comprising: a body having nose and a tail; and a plurality of stabilizing fins projecting from the body;

a discardable segmented sabot comprising:

a plurality of longitudinal segments, having an assembled configuration surrounding the projectile and secured thereto against relative longitudinal movement, the assembled segments defining a body portion and fore and aft flanges projecting outward therefrom; and a slip obturator encircling at least a sealing one of the fore and aft flanges and having sufficient compliance to form a substantially gas-tight seal with the barrel, effective to allow the sabot and projectile to be propelled forward through the barrel by the expansion of gas behind the sealing flange, wherein at least an anti-spin one of the fore and aft flanges includes a plurality of passageways, the passageways having surfaces shaped and dimensioned to direct a portion of an expanding propellant gas through the anti-spin flange, exiting forward of the anti-spin flange with an angular velocity relative to the anti-spin flange effective to produce a torque counter to a rifling-induced torque so that the combination of the subcaliber penetrator and discardable segmented sabot exits the muzzle with a muzzle velocity and with an angular velocity substantially smaller than the product of the muzzle velocity and a pitch of the rifled barrel.

14. A discardable sabot for a subcaliber projectile to be fired from a weapon having a having a chamber and a rifled barrel extending from the chamber along a longitudinal axis to a muzzle, the system comprising:

a first support; and a second support, aft of the first support, the first and second supports configured to engage the inner surface of said barrel from which the projectile is fired so as to maintain the projectile substantially centered along a central longitudinal axis of the barrel during travel of the projectile from a chamber at the aft end of the barrel to a muzzle at the fore end of the barrel, wherein:

at least one of the first and second supports is a sealing support having a slip obturator configured to provide a substantially gas-tight seal with the barrel, effective to allow the sabot and projectile to be propelled forward through the barrel by the expansion of gas behind the sealing support;

the cooperation of the rifling of the barrel with the sabot tending to produce a first torque on the sabot in a first direction about the longitudinal axis; and the sabot includes a plurality of channels extending through the second support, each such channel configured to direct a portion of the expanding gas forward with a nonzero velocity component about the longitudinal axis relative to the second support for applying a second torque, directed substantially opposite such first torque, during travel of the sabot and projectile from the chamber to the muzzle.

15. The sabot of claim 14 wherein the sabot is formed in exactly three segments meeting at three radial planes and the sealing support is the second support.

16. The sabot of claim 14 wherein the first support defines a plurality of vents, effective to allow such portion of the expanding gas to pass forward through the first support, so as to limit backpressure caused by the first support and thereby allow such portion to have a flow rate effective to substantially counter the first torque so that after exiting the muzzle the projectile has a spin rate of less than 100 rps.

17. The sabot of claim 16 wherein each such channel is configured to direct a portion of the expanding gas forward with a positive angular velocity about the longitudinal axis.

18. The sabot of claim 14 formed primarily of a composite material and wherein each such channel is bounded by an associated metal insert in such composite material.

19. An ammunition system for use with a weapon having a chamber and a barrel extending from the chamber along a longitudinal axis to a muzzle, the system comprising:

a case, extending from a base to a mouth;

propellant, initially contained within the case; and a saboted projectile initially accommodated within the case mouth and comprising:

a subcaliber penetrator comprising: a body having nose and a tail; and a plurality of stabilizing fins projecting from the body;

a discardable sabot comprising:

an engagement portion for surrounding the projectile and engaging the projectile to prevent relative longitudinal movement;

a support dimensioned to cooperate with an inner bore of the barrel so as to maintain the projectile substantially centered along the central longitudinal axis of the barrel during travel of the projectile from the chamber to the muzzle, said support located at least partially within said mouth, a plurality of channels extending through the support and each channel initially containing a sealing device to provide a watertight and airtight seal for maintaining the integrity of the propellant, and wherein ignition of the propellant raises pressure within the case sufficiently to remove said sealing device to permit the channels to cooperate with an expanding gas behind the support and direct a portion of the expanding gas forward from the support and with a nonzero velocity component about the longitudinal axis relative to the support so as to apply a torque to at least the engagement portion.

20. The ammunition system of claim 19 for use with a rifled barrel and wherein:

the saboted projectile includes an annular deformable obturator forming a seal which accommodates the rifling of the barrel;

each sealing device is a plug which is driven out of the associated channel by said pressure; and said torque is directed counter to a spin induced by cooperation of the obturator with the barrel and is effective to cause sufficient slip between the engagement portion and the obturator so that the projectile exits the muzzle with an angular velocity about the longitudinal axis of less than 100 rps in magnitude.

21. The ammunition system of claim 19 wherein the barrel is a smoothbore barrel and wherein the channels are positioned so that the torque is positive.

* * * * *